US005270480A

United States Patent [19]

Hikawa

[11] Patent Number: 5,270,480

[45] Date of Patent: Dec. 14, 1993

[54] TOY ACTING IN RESPONSE TO A MIDI SIGNAL

[75] Inventor: Kazuo Hikawa, Yokohama, Japan

[73] Assignee: Victor Company of Japan, Ltd., Yokohama, Japan

[21] Appl. No.: 904,176

[22] Filed: Jun. 25, 1992

[51] Int. Cl.[5] ..... G10H 7/00

[52] U.S. Cl. ..... 84/645; 84/104; 446/298

[58] Field of Search ..... 84/464 A, 464 R, 645, 84/2, 104; 446/298, 300

[56] References Cited

U.S. PATENT DOCUMENTS

| | | | |
|---|---|---|---|
| 5,054,359 | 10/1991 | Hikawa | 84/645 |
| 5,056,402 | 10/1991 | Hikawa et al. | 84/645 |
| 5,142,803 | 9/1992 | Lang | 446/385 |
| 5,142,961 | 9/1992 | Paroutaud | 84/645 X |
| 5,191,615 | 3/1993 | Aldava et al. | 446/301 |

OTHER PUBLICATIONS

"MIDI Machine Control 1.0" distributed by The International MIDI Association Los Angeles, Calif.

"General MIDI Level 1 Recommended Practice" composed jointly by the MIDI Manufacturers' Association (MMC) in the United States and the Japan MIDI Specification Council (JMSC).

*Primary Examiner*—William M. Shoop, Jr.
*Assistant Examiner*—Jeffrey W. Donels
*Attorney, Agent, or Firm*—Michael N. Meller

[57] ABSTRACT

Instrument playing toy for acting a simulated instrument play comprising receiving device for receiving instrument playing information programmed originally for playing instruments electrically but not programmed for driving moving parts of a toy, decoding device for decoding the instrument playing information, converting device for converting output of the decoding device into driving signals and assigning the driving signals to moving parts of the instrument playing toy and driving device for driving the moving parts in response to the driving signals, thereby the instrument playing toy performs simulated instrument playing movements. Sound may be generated from provided acoustic musical instruments activated by the moving parts, or derived from the instrument playing information, or from a sound signal obtained from a source different from the instrument playing information.

8 Claims, 8 Drawing Sheets

| MIDI CHANNEL | ELECTRONIC MUSICAL INSTRUMENTS |
|---|---|
| 1 | PIANO |
| 2 | GUITAR |
| 3 | BASS |
| 4 | STRINGS |
| : | : |
| : | : |
| 10 | PERCUSSION |

Fig. 5A

| NOTE NUMBER (NOTE DATA) | MUSIC INSTRUMENTS (PERCUSSION) | ASSIGNMENT OF SIMULATING MOVEMENT (PLAY) | NOTE NUMBER (NOTE DATA) | MUSIC INSTRUMENTS (PERCUSSION) | ASSIGNMENT OF SIMULATING MOVEMENT (PLAY) |
|---|---|---|---|---|---|
| 35 | Acoustic Bass Drum | BASS DRUM | 59 | Ride Cymbal 2 | CYMBAL |
| 36 | Bass Drum 1 | BASS DRUM | 60 | Hi Bongo | SNARE DRUM |
| 37 | Side Stick | SNARE DRUM | 61 | Low Bongo | SNARE DRUM |
| 38 | Acoustic Snare | SNARE DRUM | 62 | Mute Hi Conga | SNARE DRUM |
| 39 | Hand Clap | SNARE DRUM | 63 | Open Hi Conga | SNARE DRUM |
| 40 | Electric Snare | SNARE DRUM | 64 | Low Conga | SNARE DRUM |
| 41 | Low Floor Tom | SNARE DRUM | 65 | High Timbale | SNARE DRUM |
| 42 | Closed Hi Hat | HI HAT | 66 | Low Timbale | SNARE DRUM |
| 43 | High Floor Tom | SNARE DRUM | 67 | High Agogo | CYMBAL |
| 44 | Pedal Hi Hat | HI HAT | 68 | Low Agogo | CYMBAL |
| 45 | Low Tom | SNARE DRUM | 69 | Cabasa | HI HAT |
| 46 | Open Hi Hat | HI HAT | 70 | Maracas | HI HAT |
| 47 | Low-Mid Tom | SNARE DRUM | 71 | Short Whistle | CYMBAL |
| 48 | Hi Mid Tom | SNARE DRUM | 72 | Long Whistle | CYMBAL |
| 49 | Crash Cymbal 1 | CYMBAL | 73 | Short Guiro | CYMBAL |
| 50 | High Tom | SNARE DRUM | 74 | Long Guiro | CYMBAL |
| 51 | Ride Cymbal 1 | CYMBAL | 75 | Claves | SNARE DRUM |
| 52 | Chinese Cymbal | CYMBAL | 76 | Hi Wood Block | SNARE DRUM |
| 53 | Ride Bell | CYMBAL | 77 | Low Wood Block | SNARE DRUM |
| 54 | Tambourine | SNARE DRUM | 78 | Mute Cuica | SNARE DRUM |
| 55 | Splash Cymbal | CYMBAL | 79 | Open Cuisa | SNARE DRUM |
| 56 | Cowbell | CYMBAL | 80 | Mute Triangle | CYMBAL |
| 57 | Crash Cymbal 2 | CYMBAL | 81 | Open Triangle | CYMBAL |
| 58 | Vibraslap | SNARE DRUM | | | |

Fig. 5B

| C0 01 | 90 3C 40 | C4 22 | 99 47 00 | 28 40 |
|---|---|---|---|---|
| *a | *b | *c | *d | *e |

EXAMPLE OF HEXADECIMAL
MIDI MESSAGE

Fig. 6

TOY ACTING IN RESPONSE TO A MIDI SIGNAL

BACKGROUND OF THE INVENTION

1. Field of the Invention

The present invention relates generally to a toy capable of performing a simulated instrument play, particularly to a toy capable of performing musical instrument playing action in synchronization with reproduced sound and/or video information contained in such as a Musical Instrument Digital Interface (MIDI) signal recorded in the subcode area of digital audio recording mediums such as compact discs (CD), or digital audio tapes (DAT), or in the MIDI signal recorded together with audio data in a data recording area of digital recording mediums such as CD-ROMs, etc., or in synchronization with reproduced sound and/or video information transmitted via satellites or cables by being accompanied by characters being transmitted (character-broadcasting).

2. Description of the Prior Art

There have been systems in which electro-mechanical driving devices such as actuators are built into an acoustic musical instrument such as piano so that the instrument is played live electro-mechanically by suitably controlling the driving devices.

An example of such prior art system is shown by a reference numeral 30 in FIG. 1. In FIG. 1, the system 30 comprises a control signal receiver 31, a control signal decoder 32 and an electro-mechanical drive unit 33. A control signal received by the control signal receiver 31, is decoded by the control signal decoder 32 and the electro-mechanical drive unit 33 is directly controlled thereby to play the acoustic musical instrument electro-mechanically.

Since such control signal is used in this system 30 to play the actual musical instrument electro-mechanically, there may be a time delay associated with the operation of the drive unit 33 itself or in relation to the mechanically driven components of the instrument, this delay can be dependent upon the playing note(pitch) of the music.

Therefore, when the drive unit is operated in response to an instrument playing information, resultant play of the musical instrument may become inaccurate. In order for such system to play music accurately, it has been required to prepare the instrument playing information designed exclusively to the system by preliminarily making time adjustments according to the musical scale. In such case, it is quite possible that such exclusively prepared playing information can not be used to play other systems than the intended one.

An example of this kind of system is an automatic piano player which plays electro-mechanically an actual acoustic piano live in response to a recorded program being reproduced. In this case, the programs for this system are quite likely exclusive to acoustic pianos, thus the programs can not generally be applied to other instruments under the control of personal computer.

Further, as shown in FIG. 2, there is a toy of prior art which simulates dancing in synchronization with played music under a limited condition. In this prior art example, the toy takes in the form of potted plant having a flower. A sound detector or microphone 41 mounted on an upper portion of the flower pot detects environmental sound, music or voice whose level is above the designed threshold for the toy. Electro-mechanical driving unit 42 which includes a motor (not shown) is provided within the flower pot. The driving unit 42 is actuated in response to an output of the sound detector 41 to move the flower as if it is dancing.

Since such toy simply reacts to the total input sound having the level over the threshold, its movement can not synchronize with a music of specific instrument which may be one of the musical instruments playing together. This problem would be evident when the sound level of such instrument is lower than others'.

Thus, the movement (instrument playing action) of this kind of toy is poor as its performance.

In order to solve this problem, it may be considered to design the toy to recognize the sound, i.e. detecting the intended sound exclusively, of such specific one of the instruments so that the toy may perform sophisticated movements reacting to the recognized sound of the specific instrument. In such a case, however, highly complicated techniques including voice recognition technology, would be required. Further, since a sound recognition system for such purpose generally require a computer, an A/D converter, a D/A converter, etc., it would become too bulky and expensive for a toy.

SUMMARY OF THE INVENTION

The present invention provides a toy which is capable of simulating an instrument playing action. The toy is featured by comprising a decoder such as MIDI decoder for decoding an instrument playing information programmed originally for electrically playing musical instruments but not programmed nor intended to drive moving parts of a toy, an example of such instrument playing information is the MIDI signal which is a kind of control signal for controlling electronically an electronic musical instrument to generate non-acoustical i.e. artificial sound from the instrument, a converter for converting the instrument playing information, e.g., Note On signal and its note number of a specific channel contained in the MIDI signal, into a plurality of drive signals to be supplied to respective moving parts of the toy and for assigning them to the respective moving parts and a drive unit responsive to the plurality of drive signals to drive the respective moving parts to thereby cause the toy to simulate an instrument playing action according to the decoded instrument playing information. The MIDI signal is a control signal for controlling sound of an electronic musical instrument which reproduces musical sound synthesized electronically.

According to the instrument playing toy constructed as mentioned above, the instrument playing information is converted into predetermined driving signals which are assigned to the respective moving parts of the toy. Therefore, the toy can simulate a playing action of a specific instrument on the basis of the instrument playing information which is not programmed for playing musical instruments directly. Accompanying sound, if desired, may be derived electrically from the instrument playing information or from other source recorded or transmitted together with the instrument playing information, or generated from acoustic instruments as a result of moving actions of the moving parts of the toy.

BRIEF DESCRIPTION OF THE DRAWINGS

FIGS. 3 and 4 show an instrument playing toy according to a first embodiment of the present invention, in which FIG. 3 shows a basic configuration thereof and FIG. 4 shows a practical construction thereof;

FIGS. 5A and 5B show an example of MIDI channel assignment to electronic musical instruments and an example of note number assignment to simulating musical instruments and to acoustic musical instruments used in the instrument playing toy shown in FIGS. 3 and 4 respectively;

FIG. 6 shows an exemplary piece of MIDI signal;

DETAILED DESCRIPTION OF THE PREFERRED EMBODIMENTS

Embodiments of an instrument playing toy according to the present invention will be described in detail with reference to the accompanying drawings.

Figure 3:
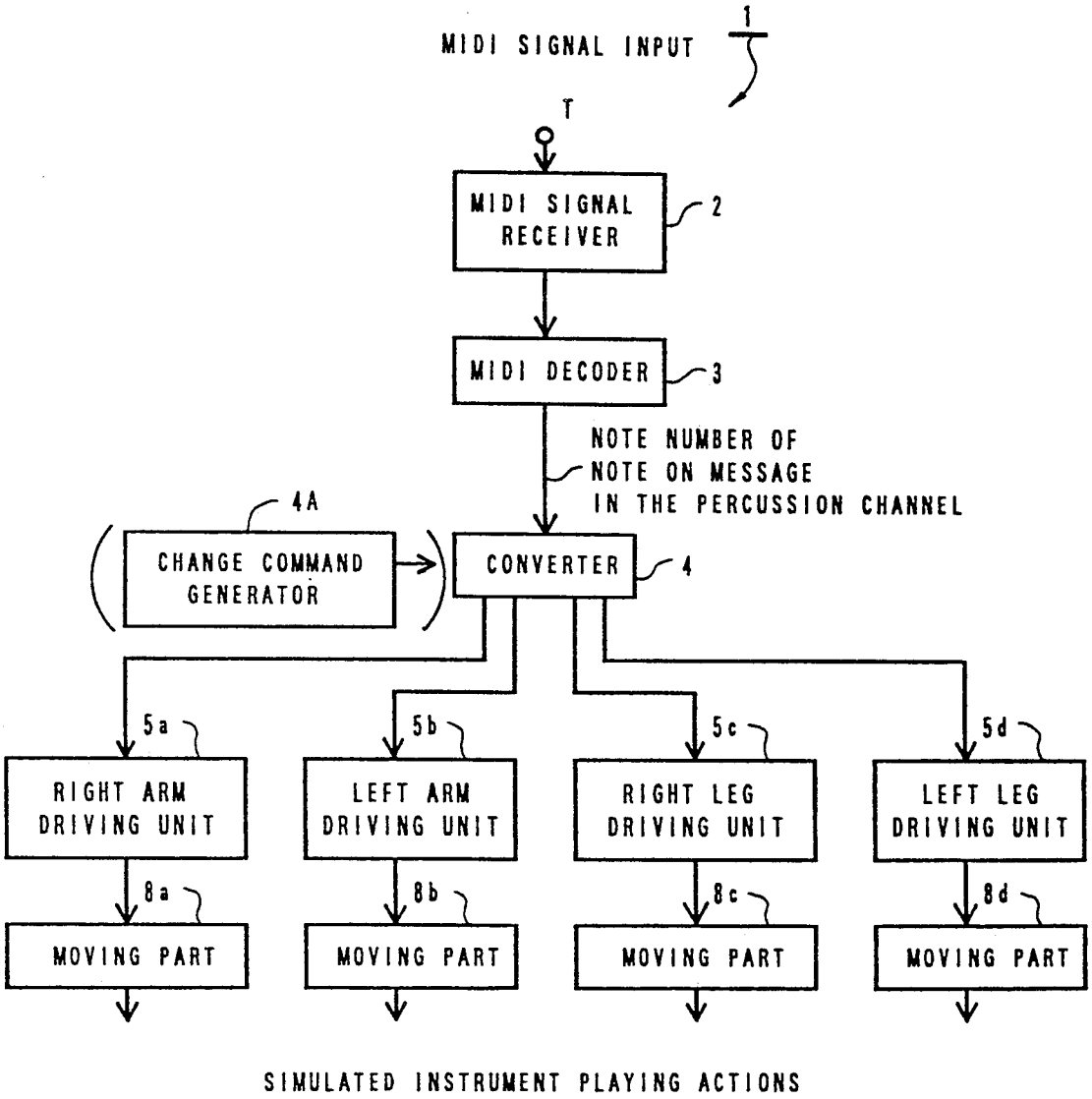

FIG. 3 shows a basic construction of the instrument playing toy of the present invention. As shown in FIG. 3, the instrument playing toy 1 is comprised of an instrument playing information receiver 2 for receiving an instrument playing information contained in a MIDI signal inputted to a terminal T, a decoder such as MIDI decoder 3 for decoding the instrument playing information received by the receiver 2, a converter 4 for converting the instrument playing information into drive signals, moving parts 8*a*–8*d* and driving units or actuators 5*a*–5*d* responsive to the drive signals to drive the moving parts to cause them to simulate an instrument playing action.

Figure 1:
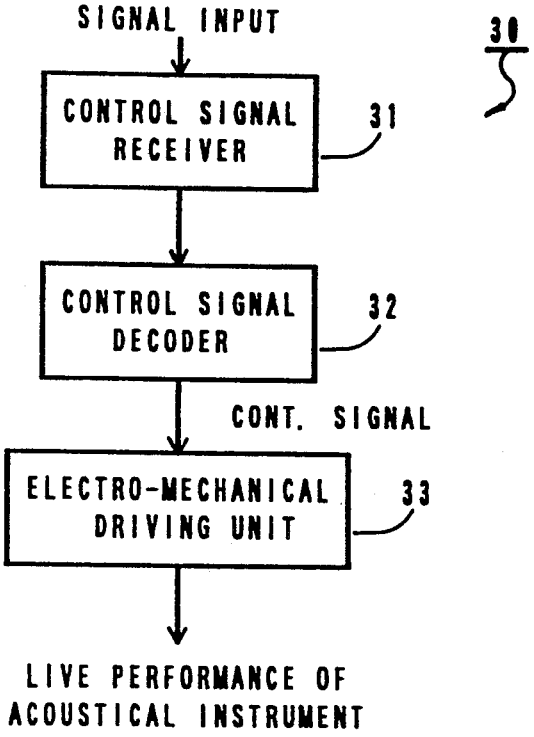
Fig. 1 PRIOR ART
FIGS. 1 and 2 show examples of a conventional playing action simulating toy.
Figure 2:
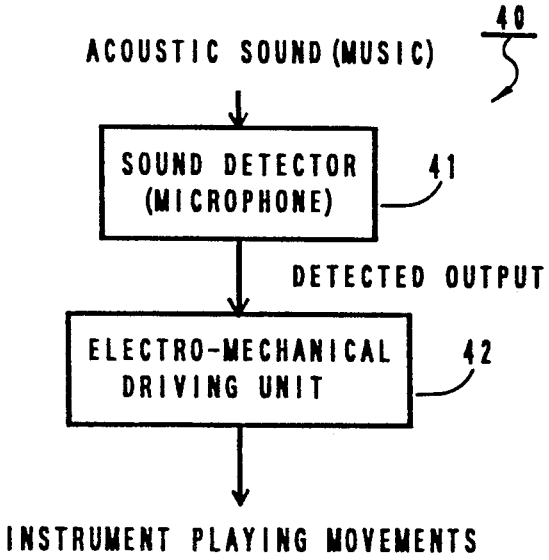
Fig. 2 PRIOR ART

The term "instrument playing information" used in this specification means a control signal such as MIDI signal preprogrammed for producing musical sound electronically synthesized by any electronic device or equipment but not originally programmed for electromechanically driving moving parts of instrument thus it does not include control signals programmed to play an acoustic musical instrument by means of such electromechanical systems as used in the conventional art shown in FIG. 1.

This instrument playing toy 1 simulates a playing action according to the instrument playing information decoded by the decoder 3. The conversion of the instrument playing information into drive signals and the assignment of them to the driving units 5*a*–5*d* are arbitrarily selected by a manufacturer of the toy and it is not always necessary to cause the toy to simulate a playing action of an electronic musical instrument intended by the instrument playing information originally.

Before describing the embodiments which utilize the MIDI signal, the format of the MIDI signal will be described. The MIDI signal is a series of data basically composed of 8-bit words called "MIDI Byte" each of which is preceded by a start bit "0" and succeeded by a stop bit "1". Thus, the MIDI signal is transmitted asynchronously as 10-bit unit serial data at a transmission rate of 31.25 baud. There are two types of MIDI Byte one is the Status Byte for identifying an instrument playing information, another is the Data Byte which carries data of instrument playing information. The most significant bit of the Status Byte is always "1" and functions to alter a status in the receiving side according to a purpose of the following Data Bytes and the most significant bit of the Data Byte is always "0". When 8-bit data are represented by two digits of hexadecimal notation, 80-FF indicate Status Bytes and 00-7F indicate Data Bytes.

As major Status Bytes, there are Note On, Note Off and Program Change, etc. Note On Status Byte is an instruction to the receiving side instructing "producing sound" and Note Off Status Byte is an instruction to the same instructing "stop producing sound". The Note On Status Byte is followed by two Data Bytes defining note data and volume data, respectively. The series of these bytes is referred to as a message. The lower 4 bits of each of the Note On, Note Off and Program Change Status Bytes, etc., designate each of channels to be described later.

Transmission of instrument playing information by means of MIDI signal, is performed as such that instrument playing information for electronic musical instruments are assigned to respective MIDI channels as shown in FIG. 5A. In this example, sound of piano is produced by an instrument (synthesizer) assigned to the channel 1, sound of percussions is produced by another instrument (rhythm machine) assigned to the channel 10 and so on.

Further, the percussions include sounds of bass drum, snare drum, cymbal, hi hat and tom, etc. In order to represent these sounds in the single MIDI channel, note data (sound pitch) called "note number", is assigned to the sound of each percussion instrument. FIG. 5B shows an example of such assignment of note numbers (referred to as note assignment) to various percussion instruments. (note number is represented by decimal number. For example, note number 36 indicates a bass drum 1.) The percussion instrument is so-called a noteless instrument and is distinguished from a note instrument such as piano. Therefore, since note data have no meaning to percussion instruments, such assignment shown in FIG. 5B is made.

Exemplary structure of MIDI signal (where a 8-bits message is represented by hexadecimal notation with 2 digits of decimal numbers or alphabetic letters or a combination of a decimal number and an alphabetic letter), is explained in detail referring to FIG. 6. (the channel and note number assignment are kept in accordance with FIGS. 5A and 5B, and in FIG. 6, a double underline indicates the Status Byte and a single underline indicates the Data Byte.)

"*a" is a Program Change message indicating a switch of the tone of channel 1 to the tone assigned to 01 (hexadecimal notation).

"*b" is a Note On message indicating that the note corresponding to 3C (hexadecimal notation) of channel 1, is sounded with volume 40 (hexadecimal). The sound volume is called "velocity" in the MIDI system in which the maximum volume is 7F, and the value 40 (hexadecimal) represents medium volume.

"*c" represents Program Change indicating a switch of the tone of channel 5 to the tone assigned to 22 (hexadecimal).

"*d" indicates that Status Byte is Note On with sound volume 0 (zero) which corresponds to the Note Off in the MIDI system, and therefore it means no sound generation. The channel is 10 i.e. the percussion channel. Since 47 in hexadecimal notation corresponds to 71 in decimal notation, it is equivalent to turning the short whistle off as per FIG. 5B.

"*e" indicates an example using a Running Status and, since content is based on the same Status Byte (99 of *d), the Status Byte is omitted. That is, it indicates that a tone represented by 28 (hexadecimal notation) of the channel 10 (percussion channel) is generated with a medium sound volume. This tone is electric snare drum (28 in hexadecimal notation corresponds to 40 in decimal notation).

FIRST EMBODIMENT

As a first embodiment of the present invention having a basic configuration shown in FIG. 3, a toy which utilizes an instrument playing information for percussion instruments carried in a MIDI signal recorded on a digital recording medium and causes its doll sitting in front of a toy drum set to play with the drums, will be described in detail.

Figure 4:
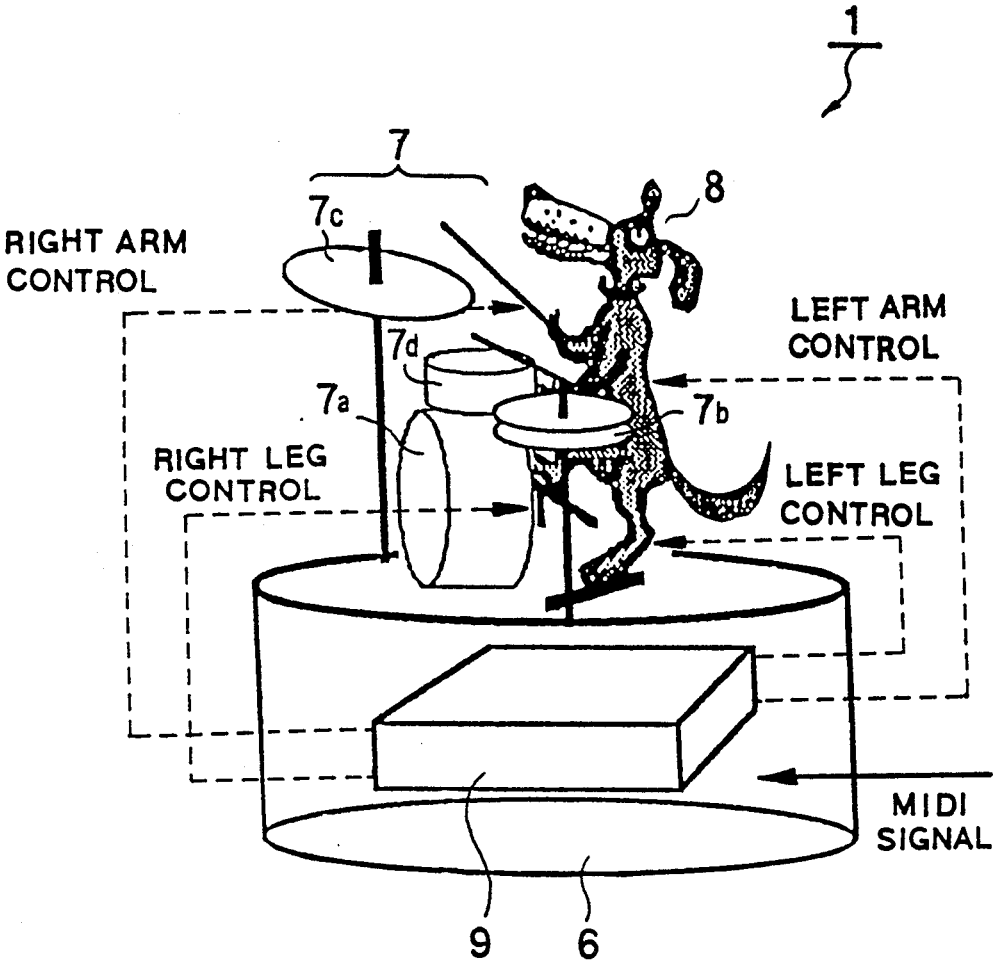

FIG. 4 shows the toy 1 including a doll 8 and a drum set 7 disposed on a pedestal 6. The drum set 7 includes a bass drum *7a* which is to be played with a right leg of the doll, a hi hat *7b* to be played with a left leg, a cymbal *7c* to be played with a right hand and a snare drum *7d* to be played by a left hand. A reference numeral 9 indicates a control box housing the decoder 3, the converter 4, etc., shown in FIG. 3.

Referring to FIG. 3, the MIDI signal inputted to an input terminal "T" is wave-shaped in the MIDI signal receiver 2 and supplied to the MIDI decoder 3.

The MIDI decoder 3 derives a Note On signal of a percussion channel (Status Byte 99 which is a Note On signal of channel 10 and associated two bytes indicating a note number and a volume information, respectively). The note number is converted by a converter 4 and supplied to driving units *5a–5d*. The driving units *5a–5d* respond to on-off switchings of control signals to drive moving parts *8a–8d* of the doll sitting in front of the drum set, that is, right and left feet, and right and left hands which cause, by hitting in this case, the respective acoustical musical instruments *7a–7d* to generate sound acoustically.

The MIDI decoder 3 and the converter 4 are usually constituted with a microcomputer. The driving units *5a–5d* are constituted with driving transistors, actuators and springs, etc., and these drums are played as such that the moving parts *8a–8d* hit them as the actuators are energized and are retracted to home positions by the springs as the actuators are deenergized.

Figure 7:
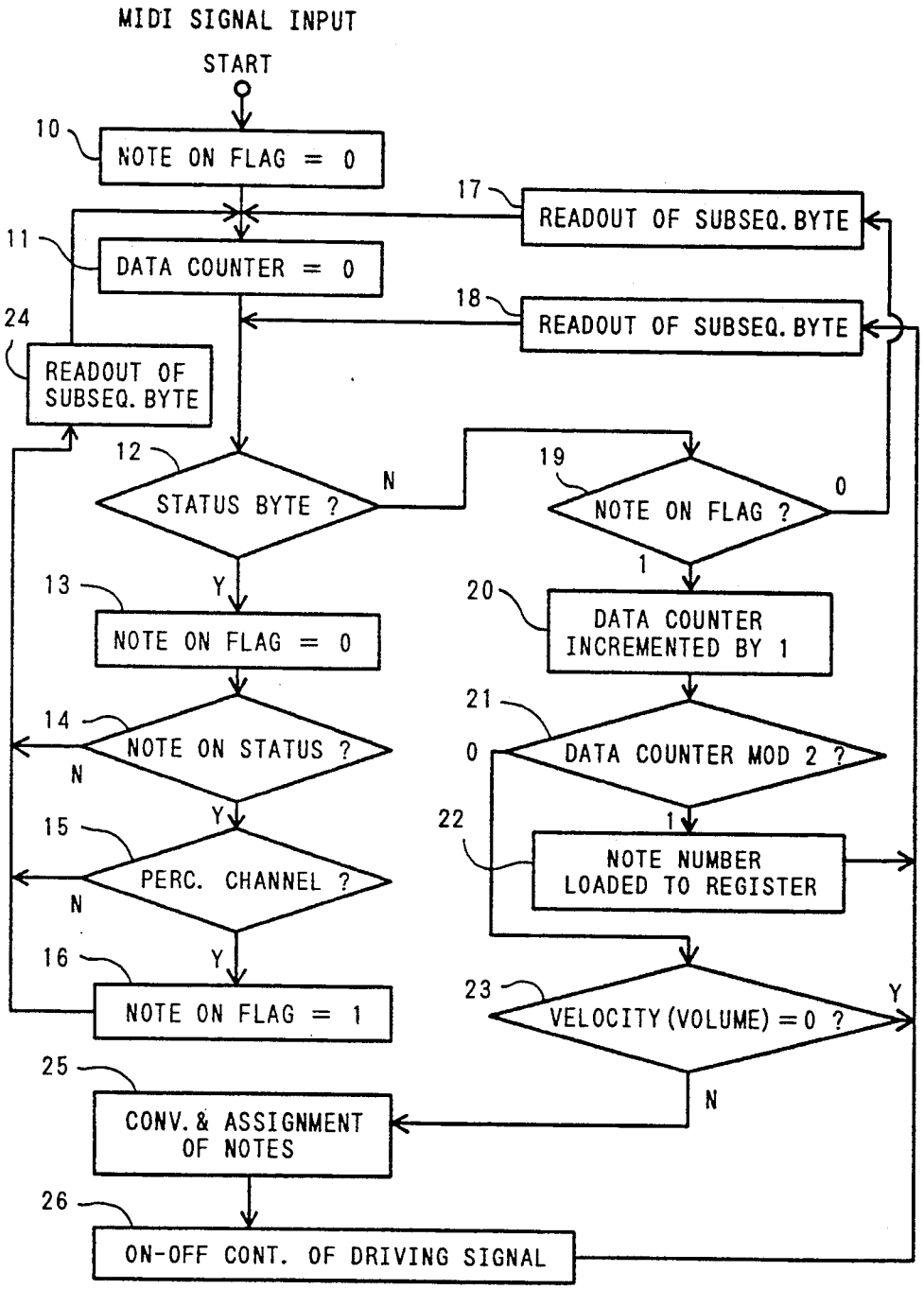
FIG. 7 is a flowchart showing an operation of a MIDI decoder and a converter which are utilized by a microcomputer.

FIG. 7 shows a flowchart of operation of the MIDI decoder 3 and the converter 4 when they are utilized by a microcomputer. The flow will now be described.

In the flowchart shown in FIG. 7, a case where a MIDI signal shown in FIG. 6 is used, will be described. The flowchart is intended to operate such that the Status Byte and Data Byte are separated from the input MIDI signal (including a plurality of 2-digit numbers in hexadecimal notation), and note numbers (names of instruments) belonged to the Note On message in the percussion channel (channel 10), are detected and outputted (steps 10–24). Then, the detected note numbers are converted according to a predetermined conversion table (assignment shown in FIG. 5B) to obtain driving signals by which the doll 8 is operated. (steps 25 and 26)

Initially, in the step 10, a Note On flag indicating whether or not a current status is a Note On of the percussion channel, is reset to 0 (not Note On). Then, in the step 11, a data counter whose content indicates the number of Data Bytes which are successive up to now, is reset to 0. Then, in the step 12, it is checked whether or not it is a Status Byte (if 80-FF, it is a Status Byte). If the MIDI signal is started with a Data Byte, the decoder can not decode it since it is impossible to determine what is the status to which that Data Byte belongs. In such a case, a next byte is read in through the steps 12, 19 and 17.

The byte read in first, is CO of *a. Since this is a Status Byte, a result in the step 12 is Y (Yes) and the process proceeds to the step 13. In the step 13, the Note On flag is temporarily reset to 0 and a content of the status is determined in the step 14. If it is any of 90-9F, it is a Note On Status Byte. Since CO of *a is a status byte indicating a program change, a result is N (No). Therefore, a next byte is read in in the step 24 and the process returns to the step 11. In the step 24, 01 of a second byte of *a is read in. The data counter stays at 0, but is made to 0 in the step 11 and the process moves to the step 12. Since it is a Data Byte in the step 12, the process moves to the step 19. Since the Note On flag is still 0 because a current status is program change, a next byte is read in in the step 17.

The next byte is 90 of *b. The process passes through the step 11 to the step 12 in which the next byte is determined to be a Status Byte which is passed to the step 14 as the Note On flag stays on 0, and it proceeds to the step 15 since 90 of *b is a Note On message. In the step 15, it is determined whether or not the channel of the Note On message is the percussion channel. In this example, since the percussion channel is made to the channel 10 (9 of MIDI in hexadecimal notation), a result is N (if 99, then it is the Note On message of the percussion channel) and a next byte is read-in in the step 24.

The next byte is 3C of *b. In this case, the steps 11, 12 and 19 are passed and a next byte is read-in in the step 17. 40 of *b of the next byte is processed in the same manner. The subsequent two bytes (*c) are program change messages and therefore processed in the same way as those 2 bytes of *a.

99 of the first byte of *d is checked through the steps 11, 12, 13 and 14 to the step 15. In the step 15 it is determined as the percussion channel 10 and moved to the step 16 in which the Note On flag is set to 1. And, a next byte is read in in the step 24.

Since the next byte is 47 of *d, it is checked through the steps 11, 12 to the step 19. Since the Note On flag is 1 in the step 19, the process moves to the step 20 in which the data counter is made increment by one to indicate that it is the first byte of the Data Bytes based on the Note On status. Then, in the step 21, it is determined whether it is even numbered (second byte) byte or odd numbered byte (first byte). (MOD indicates a remainder when divided by 2). In this case, since the data counter is 1 indicating that the byte is the first one of the Data Bytes, it is determined to be note data (note number). Accordingly, this value is temporarily stored in a register (in the step 22) and then a next byte is read in in the step 18. Considering the occasion that the next Data Byte happens to indicate zero sound volume which is equivalent to Note Off, the process does not proceed immediately to the practical movement control operations.

The next byte is 00 of *d and, since it does not pass through the step 11, the data counter stays on 1 and the process is moved to the steps 12, 19, 20, 21 and 23. In the step 23, a result is Y since velocity (volume data)=0 and the process is returned to the step 18.

The next byte is 28 of *e which is processed through the steps 12, 19, 20, 21 and 22 causing register to hold "28". The next byte 40 read in the step 18, has a velocity (volume information)=0 and, therefore, the process moves through the steps 12, 19, 20, 21 and 23 and the process moves to the step 25 for note-assignment conversation. The steps mentioned above are execution steps of the MIDI decoder 3 and the following steps are execution steps of the converter 4.

The step 25 is to determine whether an input note number is assigned to any of legs and arms of the doll 8, which corresponds to the acoustical musical instruments *7a–7d* shown in FIG. 4 according to the table of FIG. 5B. An example of assignment of legs and arms of the doll to drums instruments is shown in below:

| | | |
|---|---|---|
| Right Leg: Bass Drum | (BD) | ... note numbers are assigned as per FIG. 5B. |
| Left Leg: Hi Hat | (HH) | |
| Right Arm: Cymbal | (CY) | |
| Left Arm: Snare Drum | (SD) | |

That is, note numbers are assigned to a specific moving part for its simulated instrument playing movement, for example, note numbers 35 and 36 in decimal number are assigned to the right leg of the bass drum (BD).

Although some percussion instruments listed in FIG. 5 do not correspond to or related to the above mentioned four instruments in actual sound, it may be better to produce some sound rather than wasting (producing nothing). For this reason, some note number such as for conga (note number 62, etc.) may be assigned to the snare drum SD and/or the note number for cowbell (note number 56, etc.) may be assigned to the cymbal SY as an alternative. It is of course technically possible for a toy provided with instruments as many as available note numbers for musically corresponding instruments. However, such scheme would be economically unrealistic for a toy. It is rather simple yet amusing to make a plurality of note numbers being assigned to a single movement (moving part). Exception may be a whistle included in the MIDI note numbers, sound of which is quite different from usual percussion instruments and it is awkward if such note number is assigned to drive the drums of the toy. Thus is better not to be assigned to any instrument.

Like Mute Request, there is a note number in the MIDI system, which does not directly produce sound of any instrument. In such a case, the program is prepared as such that the note number is not assigned to any moving part (do not provide on-off signal for control) and the process returns to the step 18.

Thereafter, in the step 26, the drive signals are controlled on and off as a result of assigned note numbers to the respective moving parts *8a–8d*, that is, the legs and arms of the doll. In case of *e in FIG. 6, 28 (40 in decimal notation) is the snare drum SD. Therefore, the drive signal for the left arm is made on and off which causes the arm to beat a toy snare drum *7d*. Then, the process is returned to the step 18 and waits for a subsequent inputting byte.

Thus the process shown in FIG. 7 is repeated. In this embodiment, the drive signal is controlled on-off on the basis of only Note On messages (note numbers). Reason for this, is that sound resonates well of the toy drums if drum sticks are retracted immediately after beating the drums. The interval between the "on" and "off" of the drive signal may be adjusted by taking strokes (actual movement) of the respective legs and arms and tone of the drums into account. Further, the drive signals may be used for not only beating the drums but also for flashing lights, etc., mounted on the respective drums. Further, the beating force may be regulated according to the MIDI velocity (volume) information.

The operation of the MIDI decoder 4, when it is realized by a microcomputer, has been described assuming that the process is performed by a software of the microcomputer. However, the same can be realized by using hardware for performing similar processes.

Further, although the present embodiment has been described as to the case where the doll plays directly toy instruments capable of producing sounds acoustically, that is, an example in which musical sound is produced acoustically from these toy instruments. However, it may be impractical for toy to have expensive instruments or a number of instruments or to make a structure of the toy itself sophisticated for playing a music more precisely, as it makes the toy very expensive.

SECOND AND THIRD EMBODIMENTS

In embodiments shown in FIGS. 8 and 9 to be described next, a toy simulates an instrument playing performance while musical instruments (not shown) associated therewith are fakes and do not produce any sound. Instead, sound is produced by a synthesizer or sound may be a recorded music reproduced from loudspeakers (not shown).

Figure 8:
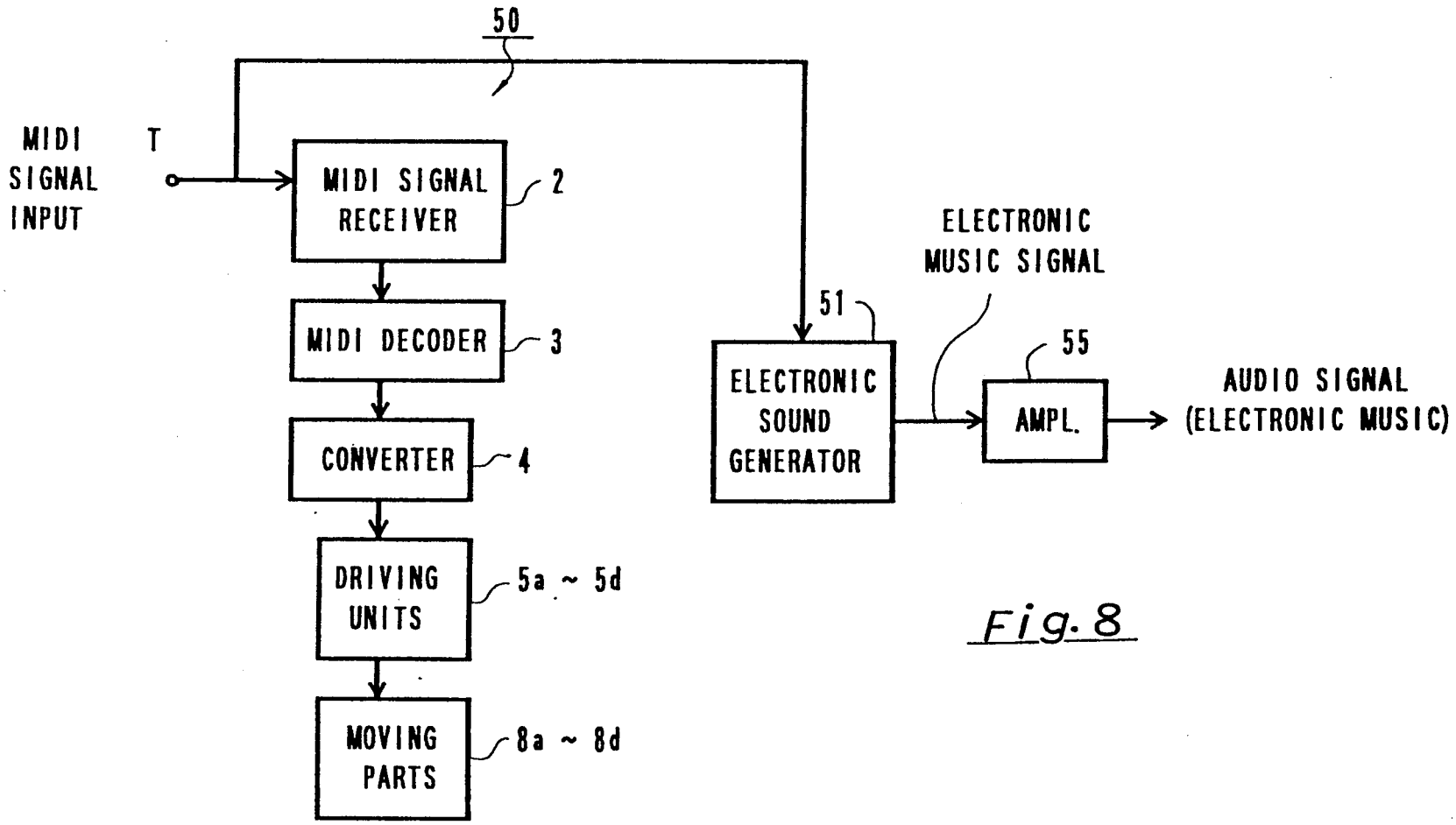
FIGS. 8 and 9 show a second embodiment and a third embodiment of the present invention, respectively.

The second embodiment of the present invention shown in FIG. 8 shows a toy which simulates an instrument playing movement according to an instrument playing information decoded by a decoder, in such a manner that the action of the toy is synchronized with electrically produced musical sound, for example, musical sound according to MIDI signal recorded in an auxiliary recording region (for example, subcode) of a digital recording medium. As shown in FIG. 8, the playing toy 50 is constituted with the input terminal "T", an instrument playing information (MIDI signal) receiver 2, a decoder (MIDI decoder) 3 for decoding the instrument playing information, electronic (music) sound generator 51 (for example, a synthesizer) for producing musical sound electrically according to the MIDI signal (instrument playing information), a converter 4 for converting the instrument playing information into drive signals, driving units *5a–5d* for performing a playing action according to the drive signals and moving parts *8a–8d* driven by means of the driving units *5a–5d*. The instrument playing toy according to the second embodiment differs from that of the first embodiment shown in FIG. 1 in that the MIDI signal is used according to its original intention to produce electronic musical sound by an electronic sound generator (synthesizer) 51 and an amplifier 55 which are included additionally, so that the toy is feature by the electronic musical sound and the drive signals both produced simultaneously from the instrument playing information (MIDI signal) obtained from a medium.

Figure 9:
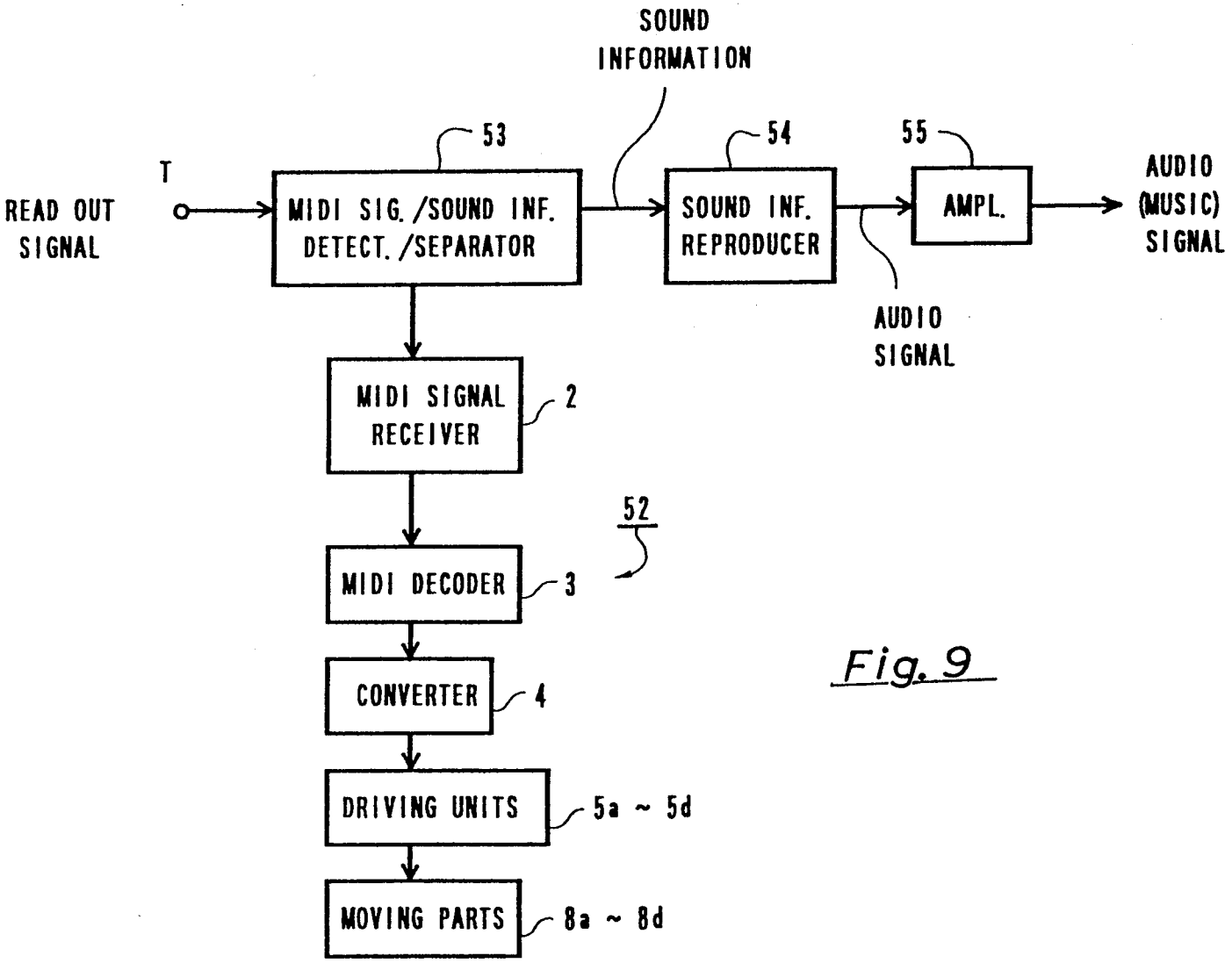

Further, in the third embodiment of the present invention shown in FIG. 9, a toy simulates a playing action according to a decoded MIDI signal which is carried by such as a subcode of a compact disc, the sound to be produced simultaneously is derived from audio data which may be recorded in the main channel of the same compact disc. As shown in FIG. 9, an instrument playing toy 52 is constituted with an input terminal "T" for receiving α read out signal, detector/separator 53 for detecting a MIDI signal and a sound information from the read out signal read out from a recording medium and inputted to the terminal "T", and separating them each other, a MIDI signal receiver 2 for receiving the separated MIDI signal, a MIDI decoder 3 for decoding the MIDI signal i.e. the instrument playing information, a converter 4 for converting the instrument playing information into drive signals, driving units 5*a*-5*d* for causing performing actions of the toy according to the drive signals, moving parts 8*a*-8*d* driven by the driving units, sound information reproducer 54 for obtaining an audio signal from the sound information separated by the detector/;separator 53, and an amplifier 55 for amplifying the audio signal. The toy according to the third embodiment differs from the first embodiment shown in FIG.4 in that it has additionally the detector/separator 53, the sound information reproducer 54 and the amplifier 55, and is featured by that the audio signal obtained from the recording medium and the drive signals derived from the MIDI signal for driving the moving parts 8*a*-8*d*, are generated simultaneously.

It is possible as a form of products that major portions of the present invention are built into a reproducing player or a receiver, and the driving signals for driving the moving parts of the toy, are outputted directly from such products when utilizing, as the instrument playing information, a MIDI signal recorded in a subcode region of a digital audio recording medium such as CD or DAT, etc. to be reproduced by the reproducing player, or a MIDI signal recorded in a data recording region of a digital recording medium together with audio data, such as CD-ROM, etc. to be reproduced by the reproducing player, or when such instrument playing information is transmitted via a character broadcasting, satellite broadcasting or cable television broadcasting to be received by the receiver.

The present invention is applicable to a game machine using a ROM cartridge or a CD-ROM or to a system for transmitted MIDI data via a telephone line or an RF communication link, which has currently been available commercially.

It is also possible to move arms or a neck of a doll sitting against a piano or having a guitar with it in synchronization with a Note On message of a MIDI channel in which a playing information for piano or guitar is included. As another variation of the present invention may be a doll which simulates playing a flute or dancing using a rhythm information (percussion information). In this regard, it is not always necessary to simulate actions of playing musical instruments which are originally intended in the instrument playing information.

Further, in the example mentioned with respect to FIG. 3, it is possible to add a change command generator 4A for arbitrarily changing the note number assignment i.e. replacing a conversion table such as shown as FIG. 5B which is to be referred in the step 25 of FIG. 7.

As described in detail herein, according to the instrument playing toy of the present invention, when an automatic play or sound reproduction is performed by utilizing a MIDI signal recorded in a digital recording medium, or instrument playing information carried via various forms of broadcasting, it becomes possible to simulate instrument playing movements (performing actions) of musical instruments in synchronization with audio or video programs carried thereby, in particular, it can be synchronized with a specific instrument contained in the program.

The features and advantages of the present invention can be summarized as follows:

(1) In the case of the first embodiment, a playing action is simulated by the doll by converting an instrument playing information into drive signals for driving moving parts of the doll, where the instrument playing information is originally not intended nor programmed to drive something mechanically, but is preprogrammed for electrically generating sound from an electronic musical instrument. This is different from an electronic musical instrument (synthesizer) which simply generates electronic sound in response to a received MIDI signal. Further, this is also different from an instrument playing robot which simply plays an acoustic instrument in response to a signal programmed for driving moving components of the robot correspondingly with the music to be played.

(2) The present invention differs from a toy in which a doll is moved in response to a picked up environmental sound by means of microphone, the toy of present invention does not utilize any acoustic sound for movements.

(3) The second embodiment of the present invention features that unlike an automatic acoustic piano player in which keys are driven by actuators, it does not mechanically play musical instruments, instead, musical sound is reproduced by an electronic sound generator such as synthesizer, therefore, there develops no delay of sound generation and more sophisticated or complicated music reproduction is possible.

(4) In the third embodiment of the present invention, musical sound is obtained from a musical signal originally prepared therefor, however, the movement of the doll is derived by converting an instrument playing information originally intended to produce musical sound electrically, therefore, the toy of the present invention differs from a musical instrument playing robot which simulates a playing movement correspondingly with reproduced music. Such conventional musical instrument playing robot is either the type mentioned in the above item (1) which is programmed to play an acoustic instrument directly, or the type in which musical sound is electrically reproduced from a sound signal and simulated synchronized movement with the sound, is obtained by actuators driven by signals programmed therefor and recorded together with the sound signal on a common medium, thus no conversion to driving signals is involved.

What is claimed is:

1. toy for simulating a play of musical instruments comprising:

moving parts simulating playing said musical instruments;

means for receiving a MIDI signal including note numbers which are originally not programmed to move parts of a toy;

means for decoding said note numbers of said MIDI signal;

means for converting said decoded note numbers of said MIDI signal outputted from said decoding means into a plurality of actuating signals and respectively assigning said plurality of actuating signals to said moving parts; and means for driving said moving parts responsive to said plurality of actuating signals assigned to said moving parts, whereby said instrument playing toy simulates said play of musical instruments.

2. A toy as claimed in claim 1, wherein said musical instruments are acoustic musical instruments.

3. A toy as claimed in claim 1, further comprising means for generating sound from said note numbers of said MIDI signal received by said receiving means.

4. Instrument playing toy claimed in claim 3, wherein said sound is musical sound, and wherein said musical instruments are pseudo musical instruments played by said moving parts in synchronization with said musical sound.

5. Instrument playing toy claimed in claim 3, wherein said sound is electronic sound generated from said note numbers of MIDI signal so that said instrument playing toy simulates said play of musical instruments concurrently with said electronic sound generated by said generating means.

6. Instrument playing toy claimed in claim 1, wherein said MIDI signal is accompanied by audio data and said receiving means further comprises means for detecting and separating said MIDI signal and said audio data, and wherein said instrument playing toy further comprises means for reproducing said audio data separated by said detecting and separating means so that said instrument playing toy simulates said play of musical instruments concurrently with said audio data reproduced by said reproducing means.

7. A toy as claimed in claim 1, further comprising means for causing said converting means to change assignment of said plurality of actuating signals to said moving parts.

8. Instrument playing toy claimed in claim 1, wherein said converting means assigns decoded note numbers of said MIDI signal to a single moving part of said moving parts.

* * * * *